US007522124B2

(12) United States Patent
Smith et al.

(10) Patent No.: US 7,522,124 B2
(45) Date of Patent: Apr. 21, 2009

(54) INDEFINITE MATERIALS

(75) Inventors: David R. Smith, Durham, NC (US); David Schurig, Durham, NC (US)

(73) Assignee: The Regents of the University of California, Oakland, CA (US)

( * ) Notice: Subject to any disclaimer, the term of this patent is extended or adjusted under 35 U.S.C. 154(b) by 567 days.

(21) Appl. No.: 10/525,191

(22) PCT Filed: Aug. 29, 2003

(86) PCT No.: PCT/US03/27194

§ 371 (c)(1), (2), (4) Date: Aug. 22, 2005

(87) PCT Pub. No.: WO2004/020186

PCT Pub. Date: Mar. 11, 2004

(65) Prior Publication Data

US 2006/0125681 A1 Jun. 15, 2006

Related U.S. Application Data

(60) Provisional application No. 60/406,773, filed on Aug. 29, 2002.

(51) Int. Cl.
*H01Q 15/22* (2006.01)

(52) U.S. Cl. ..... 343/909; 343/873

(58) Field of Classification Search ..... 343/909, 343/872, 873, 700 MS, 753, 911 R
See application file for complete search history.

(56) References Cited

U.S. PATENT DOCUMENTS

| | | | | |
|---|---|---|---|---|
| 3,934,566 | A | 1/1976 | Ward | 123/119 E |
| 5,498,644 | A | 3/1996 | Reo | |
| 5,600,342 | A * | 2/1997 | Pikulski et al. | 343/909 |
| 5,606,335 | A | 2/1997 | English et al. | |
| 5,635,453 | A | 6/1997 | Pique et al. | 505/239 |
| 6,034,638 | A | 3/2000 | Thiel et al. | 343/702 |
| 6,097,271 | A | 8/2000 | Kozakoff | 333/204 |
| 6,117,517 | A | 9/2000 | Diaz et al. | 428/102 |
| 6,469,682 | B1 * | 10/2002 | de Maagt et al. | 343/909 |
| 6,759,985 | B2 * | 7/2004 | Acher et al. | 343/700 MS |
| 6,791,432 | B2 | 9/2004 | Smith et al. | 333/99 |
| 2003/0002045 | A1 | 1/2003 | Nemat-Nasser et al. | 356/445 |

OTHER PUBLICATIONS

V.G. Veselago, "The Electrodynamics of Substances with Simultaneously Negative Values of ϵ and μ", Jan.-Feb. 1968, vol. 10, No. 4, p. 509-514.

R.N. Bracewell, Analogues of an Ionized Medium. *Wireless Engineer*, pp. 320-326, Dec. 1954.

Walter Rotman, Plasma Simulation by Artificial Dielectrics and Parallel-Plate Media. *PGAP*, pp. 82-95, Oct. 1961.

(Continued)

*Primary Examiner*—Michael C Wimer
(74) *Attorney, Agent, or Firm*—Greer, Burns & Crain, Ltd.

(57) ABSTRACT

A compensating multi layer material includes two compensating layers adjacent to one another. A multi-layer embodiment of the invention produces subwavelength near-field focusing, but mitigates the thickness and loss limitations of the isotropic "perfect lens". An antenna substrate comprises an indefinite material.

29 Claims, 6 Drawing Sheets

OTHER PUBLICATIONS

D.R. Smith, R. Dalichaouch, N. Kroll, S. Schultz, P.M. McCall, and S.L. Platzman; Photonic band Structure and Defects in One and Two Dimensions. *Journal of the Optical Society of America B*, 10(2): 314-321, 1993.

J.B. Pendry, A.J. Holden, W.J. Stewart, and I. Youngs; Extremely Low Frequency Plasmons in Metallic Mesostructures. *Physical Review Letters*, 76(25): 4773-4776, 1996.

W. Bruns, GdfidL: A Finite Difference Program for Arbitrarily Small Perturbations in Rectangular Geometries. *IEEE Transactions on Magnetics*, 32(3): 1453-1456, 1996.

J.B. Pendry, A.J. Holden, D.J. Robbins, and W.J. Stewart; Low Frequency Plasmons in Thin-Wire Structure. *J. Phys.: Condens. Matter*, 10: 4785-4809, 1998.

D.R. Smith, D.C. Vier, W. Padilla, S.C. Nemat-Nasser, and S. Schultz; Loop-Wire Medium For Investigating Plasmons at Microwaves Frequencies. *Applied Physics Letters*, 75(10): 1425-1427, 1999.

J.B. Pendry, A.J. Holden, D.J. Robbins, and W.J. Stewart; Magnetism From Conductors And Enhanced Nonlinear Phenomena. *IEEE Transactions on Microwave Theory and Techniques*, 47(11)2075-2084, 1999.

D.R. Smith, W.J. Padilla, D.C. Vier, S.C. Nemat-Nasser, and S. Schultz; Composite Medium With Simultaneously Negative Permeability and Permittivity. *Physical Review Letters*, 84(18): 4184-4187, 2000.

* cited by examiner

INDEFINITE MATERIALS

PRIORITY CLAIM

Applicants claim priority benefits under 35 U.S.C. §119 on the basis of Patent Application No. 60/406,773, filed Aug. 29. 2002.

STATEMENT OF GOVERNMENT INTEREST

This invention was made with Government assistance under DARPA Grant No. N00014-01-1-0803 and KG3523, DOE Grant No. DEFG03-01ER45881, and ONR Grant No. N00014-01-1-0803. The Government has certain rights in this invention.

TECHNICAL FIELD

The present invention is related to materials useful for evidencing particular wave propagation behavior, including indefinite materials that are characterized by permittivity and permeability of opposite signs.

BACKGROUND ART

The behavior of electromagnetic radiation is altered when it interacts with charged particles. Whether these charged particles are free, as in plasmas, nearly free, as in conducting media, or restricted, as in insulating or semi conducting media—the interaction between an electromagnetic field and charged particles will result in a change in one or more of the properties of the electromagnetic radiation. Because of this interaction, media and devices can be produced that generate, detect, amplify, transmit, reflect, steer, or otherwise control electromagnetic radiation for specific purposes.

The behavior of electromagnetic radiation interacting with a material can be predicted by knowledge of the material's electromagnetic materials parameters $\mu$ and $\epsilon$, where $\epsilon$ is the electric permittivity of the medium, and $\mu$ is the magnetic permeability of the medium. $\mu$ and $\epsilon$ may be quantified as tensors. These parameters represent a macroscopic response averaged over the medium, the actual local response being more complicated and generally not necessary to describe the macroscopic electromagnetic behavior.

Recently, it has been shown experimentally that a so-called "metamaterial" composed of periodically positioned scattering elements, all conductors, could be interpreted as simultaneously having a negative effective permittivity and a negative effective permeability. Such a disclosure is described in detail, for instance, in Phys. Rev. Lett. 84, 4184+, by D. R. Smith et al. (2000); Applied Phys. Lett. 78, 489 by R. A. Shelby et al. (2001); and Science 292, 77 by R. A. Shelby et al. 2001. Exemplary experimental embodiments of these materials have been achieved using a composite material of wires and split ring resonators deposited on or within a dielectric such as circuit board material. A medium with simultaneously isotropic and negative $\mu$ and $\epsilon$ supports propagating solutions whose phase and group velocities are antiparallel; equivalently, such a material can be rigorously described as having a negative index of refraction. Negative permittivity and permeability materials have generated considerable interest, as they suggest the possibility of extraordinary wave propagation phenomena, including near field focusing and low reflection/refraction materials.

A recent proposal, for instance, is the "perfect lens" of Pendry disclosed in Phys. Rev. Lett. 85, 3966+ (2000). While providing many interesting and useful capabilities, however, the "perfect lens" and other proposed negative permeability/permittivity materials have some limitations for particular applications. For example, researchers have suggested that while the perfect lens is fairly robust in the far field (propagating) range, the parameter range for which the "perfect lens" can focus near fields is quite limited. It has been suggested that the lens must be thin and the losses small to have a spatial transfer function that operates significantly into the near field (evanescent) range.

The limitations of known negative permittivity and permeability materials limit their suitability for many applications, such as spatial filters. Electromagnetic spatial filters have a variety of uses, including image enhancement or information processing for spatial spectrum analysis, matched filtering radar data processing, aerial imaging, industrial quality control and biomedical applications. Traditional (non-digital, for example) spatial filtering can be accomplished by means of a region of occlusions located in the Fourier plane of a lens; by admitting or blocking electromagnetic radiation in certain spatial regions of the Fourier plane, corresponding Fourier components can be allowed or excluded from the image.

DISCLOSURE OF INVENTION

On aspect of the present invention is directed to an antenna substrate made of an indefinite material.

Another aspect of the present invention is directed to a compensating multi-layer material comprising an indefinite anisotropic first layer having material properties of $\epsilon_1$ and $\mu_1$, both of $\epsilon_1$ and $\mu_1$ being tensors, and a thickness $d_1$, as well as an indefinite anisotropic second layer adjacent to said first layer. The second layer has material properties of $\epsilon_2$ and $\mu_2$, both of $\epsilon_2$ and $\mu_2$ being tensors, and a thickness $d_2$. $\epsilon_1$, $\mu_1$, $\epsilon_2$, and $\mu_2$ are simultaneously diagonalizable in a diagonalizing basis that includes a basis vector normal to the first and second layers, and $$\varepsilon_2 = \psi\varepsilon_1$$

$$\mu_2 = \psi\mu_1$$

where $$\psi = -\begin{bmatrix} \frac{d_1}{d_2} & 0 & 0 \\ 0 & \frac{d_1}{d_2} & 0 \\ 0 & 0 & \frac{d_2}{d_1} \end{bmatrix}$$

and $\psi$ is a tensor represented in the diagonalizing basis with a third basis vector that is normal to the first and second layers.

Still an additional aspect of the present invention is directed to a compensating multi-layer material comprising an indefinite anisotropic first layer having material properties of $\epsilon_1$ and $\mu_1$, both of $\epsilon_1$ and $\mu_1$ being tensors, and a thickness $d_1$, and an indefinite anisotropic second layer adjacent to the first layer and having material properties of $\epsilon_2$ and $\mu_2$, both of $\epsilon_2$ and $\mu_2$ being tensors, and having a thickness $d_2$. The necessary tensor components for compensation satisfy:

$$\varepsilon_2 = \psi\varepsilon_1$$

$$\mu_2 = \psi\mu_1$$

where $$\varphi = -\begin{bmatrix} \frac{d_1}{d_2} & 0 & 0 \\ 0 & \frac{d_1}{d_2} & 0 \\ 0 & 0 & \frac{d_2}{d_1} \end{bmatrix}$$

and $\phi$ is a tensor represented in the diagonalizing basis with a third basis vector that is normal to the first and second layers, where the necessary components are: $\epsilon_y$, $\mu_x$, $\mu_z$ for y-axis electric polarization, $\epsilon_x$, $\mu_y$, $\mu_z$ for x-axis electric polarization, $\mu_y$, $\epsilon_x$, $\epsilon_z$, for y-axis magnetic polarization, and $\mu_x$, $\epsilon_y$, $\epsilon_z$ for x-axis magnetic polarization; and wherein the other tensor components may assume any value including values for free space.

BEST MODE FOR CARRYING OUT THE INVENTION

Figure 1:
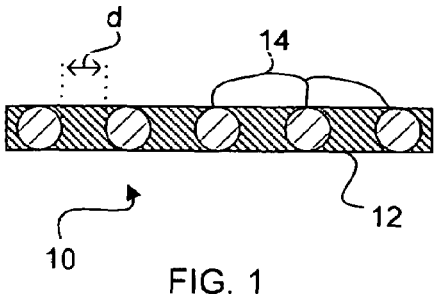
FIG. 1 is a top plan cross section of an exemplary composite material useful for practice of the invention.

Indefinite media have unique wave propagation characteristics, but do not generally match well to free-space. Therefore, a finite section of an indefinite medium will generally present a large reflection coefficient to electromagnetic waves incident from free space. It has been discovered, however, that by combining certain classes of indefinite media together into bilayers, nearly matched compensated structures can be created that allow electromagnetic waves to interact with the indefinite media. Compensating multi-layer materials of the invention thus have many advantages and benefits, and will prove of great utility in many applications.

One exemplary application is that of spatial filtering. An exemplary spatial filter of the invention can perform similar functions as traditional lens-based spatial filters, but with important advantages. For example, the spatial filter band can be placed beyond the free-space cutoff so that the processing of near-fields is possible. As the manipulation of near-fields can be crucial in creating shaped beams from nearby antennas or radiating elements, the indefinite media spatial filter may have a unique role in enhancing antenna efficiency. An additional advantage is that the indefinite media spatial filter is inherently compact, with no specific need for a lensing element. In fact, through the present invention the entire functionality of spatial filtering can be introduced directly into a multifunctional material, which has desired electromagnetic capability in addition to load bearing or other important material properties.

Multi-layer compensated materials of the invention also have the ability to transmit or image in the manner of the "perfect lens", but with significantly less sensitivity to material lossiness than devices associated with the "perfect lens." Such previously disclosed devices must support large growing field solutions that are very sensitive to material loss. These and other aspects, details, advantages, and benefits of the invention will be appreciated through consideration of the detailed description that follows.

Before turning to exemplary structural embodiments of the invention, it will be appreciated that as used herein the term "indefinite" is intended to broadly refer to an anisotropic medium in which not all of the principal components of the $\epsilon$ and $\mu$ tensors have the same algebraic sign. The multiple indefinite layers of a structure of the invention result in a highly transmissive composite structure having layers of positively and negatively refracting anisotropic materials. The compensating layers have material properties such that the phase advance (or decay) of an incident wave across one layer is equal and opposite to the phase advance (or decay) across the other layer. Put another way, one layer has normal components of the wave vector and group velocity of the same sign and the other layer has normal components of opposite sign. Energy moving across the compensating layers therefore has opposite phase evolution in one layer relative to the other.

Exemplary embodiments of the present invention include compensated media that support propagating waves for all transverse wave vectors, even those corresponding to waves that are evanescent in free space; and media that support propagating waves for corresponding wave vectors above a certain cutoff wave vector. From the standpoint of spatial filtering, the latter embodiment acts in the manner of a high-pass filter. In conjunction with compensated isotropic positive and negative refracting media, compensated indefinite media can provide the essential elements of spatial filtering, including high-pass, low-pass and band-pass.

For convenience and clarity of illustration, an exemplary invention embodiment is described as a linear material with $\epsilon$ and $\mu$ tensors that are simultaneously diagonalizable:

$$\varepsilon = \begin{pmatrix} \varepsilon_x & 0 & 0 \\ 0 & \varepsilon_y & 0 \\ 0 & 0 & \varepsilon_z \end{pmatrix}, \quad \mu = \begin{pmatrix} \mu_x & 0 & 0 \\ 0 & \mu_y & 0 \\ 0 & 0 & \mu_z \end{pmatrix}.$$

Those skilled in the art will appreciate that "metamaterials," or artificially structured materials, can be constructed that closely approximate these $\mu$ and $\epsilon$ tensors, with elements of either algebraic sign. A positive definite medium is characterized by tensors for which all elements of have positive sign; a negative definite medium is characterized by tensors for which all elements have negative sign. An opaque medium is characterized by a permittivity tensor and a permeability tensor, for which all elements of one of the tensors have the opposite sign of the second. An indefinite medium is characterized by a permittivity tensor and a permeability tensor, for which not all elements in at least one of the tensors have the same sign.

Specific examples of media that can be used to construct indefinite media include, but are not limited to, a medium of conducting wires to obtain one or more negative permittivity components, and a medium of split ring resonators to obtain one or more negative permeability components. These media have been previously disclosed and are generally known to those knowledgeable in the art, who will likewise appreciate that there may be a variety of methods to produce media with the desired properties, including using naturally occurring semiconducting or inherently magnetic materials.

In order to further describe exemplary metamaterials that comprise the layers of a multi-layer structure of the invention, the simple example of an idealized medium known as the Drude medium may be considered which in certain limits describes such systems as conductors and dilute plasmas. The averaging process leads to a permittivity that, as a function frequency, has the form $$\epsilon(f)/\epsilon_0=1-f_p^2/f(f+i\gamma) \qquad \text{EQTN. 1}$$

where f is the electromagnetic excitation frequency, $f_p$ is the plasma frequency and $\gamma$ is a damping factor. Note that below the plasma frequency, the permittivity is negative. In general, the plasma frequency may be thought of as a limit on wave propagation through a medium: waves propagate when the frequency is greater than the plasma frequency, and waves do not propagate (e.g., are reflected) when the frequency is less than the plasma frequency, where the permittivity is negative. Simple conducting systems (such as plasmas) have the dispersive dielectric response as indicated by EQTN 1.

The plasma frequency is the natural frequency of charge density oscillations ("plasmons"), and may be expressed as:

$$\omega_p=[n_{eff}e^2/\epsilon_0 m_{eff}]^{1/2}$$

and $$f_p=\omega_p/2\pi$$

where $n_{eff}$ is the charge carrier density and $m_{eff}$ is an effective carrier mass. For the carrier densities associated with typical conductors, the plasma frequency $f_p$ usually occurs in the optical or ultraviolet bands.

Pendry et al. in "Extremely Low Frequency Plasmons in Metallic Mesostructures," Physical Review Letters, 76(25): 4773-6, 1996, teach a thin wire media in which the wire diameters are significantly smaller than the skin depth of the metal can be engineered with a plasma frequency in the microwave regime, below the point at which diffraction due to the finite wire spacing occurs. By restricting the currents to flow in thin wires, the effective charge density is reduced, thereby lowering the plasma frequency. Also, the inductance associated with the wires acts as an effective mass that is larger than that of the electrons, further reducing the plasma frequency. By incorporating these effects, the Pendry reference provides the following prediction for the plasma frequency of a thin wire medium:

$$f_p^2=\frac{1}{2\pi}\left(\frac{c_0^2/d^2}{\ln\left(\frac{d}{r}\right)-\frac{1}{2}(1+\ln\pi)}\right)$$

where $c_0$ is the speed of light in a vacuum, d is the thin wire lattice spacing, and r is the wire diameter. The length of the wires is assumed to be infinite and, in practice, preferably the wire length should be much larger than the wire spacing, which in turn should be much larger than the radius.

By way of example, the Pendry reference suggests a wire radius of approximately one micron for a lattice spacing of 1 cm—resulting in a ratio, d/r, on the order of or greater than $10^5$. Note that the charge mass and density that generally occurs in the expression for the $f_p$ are replaced by the parameters (e.g., d and r) of the wire medium. Note also that the interpretation of the origin of the "plasma" frequency for a composite structure is not essential to this invention, only that the frequency-dependent permittivity have the form as above, with the plasma (or cutoff) frequency occurring in the microwave range or other desired ranges. The restrictive dimensions taught by Pendry et al. are not generally necessary, and others have shown wire lattices comprising continuous or noncontinuous wires that have a permittivity with the form of EQTN 1.

Figure 2:
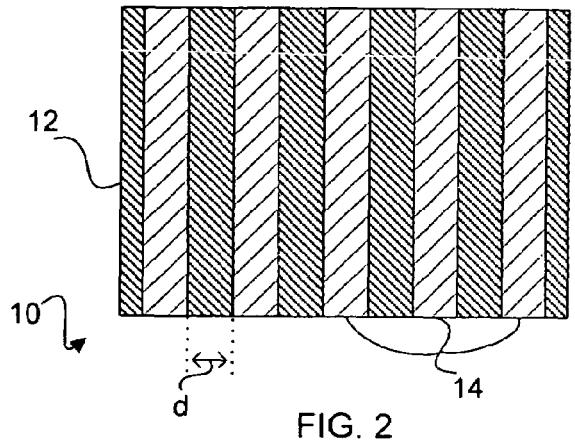
FIG. 2 is a side elevational cross section of the exemplary composite material of FIG. 1 taken along the line 2-2.

The conducting wire structure embedded in a dielectric host can be used to form the negative permittivity response in an embodiment of the indefinite media disclosed here. It is useful to further describe this metamaterial through reference to example structural embodiments. In considering the FIGS. used to illustrate these structural embodiments, it will be appreciated that they have not been drawn to scale, and that some elements have been exaggerated in scale for purposes of illustration. FIGS. 1 and 2 show a top plan cross section and a side elevational cross section, respectively, of a portion of an embodiment of a composite material 10 useful to form a meta-material layer. The composite material 10 comprises a dielectric host 12 and a conductor 14 embedded therein.

The term "dielectric" as used herein in reference to a material is intended to broadly refer to materials that have a relative dielectric constant greater than 1, where the relative dielectric constant is expressed as the ratio of the material permittivity $\epsilon$ to free space permittivity $\epsilon_0$ ($8.85\times10^{-12}$ F/m). In more general terms, dielectric materials may be thought of as materials that are poor electrical conductors but that are efficient supporters of electrostatic fields. In practice most dielectric materials, but not all, are solid. Examples of dielectric materials useful for practice of embodiments of the current invention include, but are not limited to, porcelain such as ceramics, mica, glass, and plastics such as thermoplastics, polymers, resins, and the like. The term "conductor" as used herein is intended to broadly refer to materials that provide a useful means for conducting current. By way of example, many metals are known to provide relatively low electrical resistance with the result that they may be considered conductors. Exemplary conductors include aluminum, copper, gold, and silver.

As illustrated by FIGS. 1 and 2, an exemplary conductor 14 includes a plurality of portions that are generally elongated and parallel to one another, with a space between portions of distance d. Preferably, d is less than the size of a wavelength of the incident electromagnetic waves. Spacing by distances d of this order allow the composite material of the invention to be modeled as a continuous medium for determination of permittivity $\epsilon$. Also, the preferred conductors 14 have a generally cylindrical shape. A preferred conductor 14 comprises thin copper wires. These conductors offer the advantages of being readily commercially available at a low cost, and of being relatively easy to work with. Also, matrices of thin wiring have been shown to be useful for comprising an artificial plasmon medium, as discussed in the Pendry reference.

Figure 3:
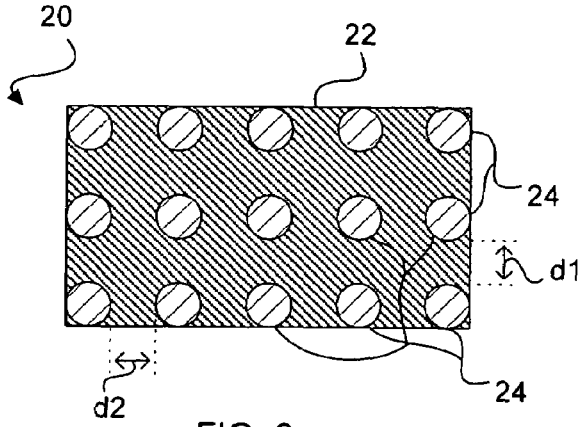
FIG. 3 is a top plan cross section of an additional exemplary composite material useful for practice of the invention.

FIG. 3 is a top plan cross section of another composite metamaterial embodiment 20. The composite material 20 comprises a dielectric host 22 and a conductor that has been configured as a plurality of portions 24. As with the embodiment 10, the conductor portions 24 of the embodiment 20 are preferably elongated cylindrical shapes, with lengths of copper wire most preferred. The conductor portions 24 are preferably separated from one another by distances d1 and d2 as illustrated with each of d1 and d2 being less than the size of a wavelength of an electromagnetic wave of interest. Distances d1 and d2 may be, but are not required to be, substantially equal. The conductor portions 24 are thereby regularly spaced from one another, with the intent that the term "regularly spaced" as used herein broadly refer to a condition of being consistently spaced from one another. It is also noted that the term "regular spacing" as used herein does not necessarily require that spacing be equal along all axis of orientation (e.g., d1 and d2 are not necessarily equal). Finally, it is noted that FIG. 3 (as well as all other FIGS.) have not been drawn to any particular scale, and that for instance the diameter of the conductors 24 may be greatly exaggerated in comparison to d1 and/or d2.

The wire medium just described, and its variants, is characterized by the effective permittivity given in EQTN 1, with a permeability roughly constant and positive. In the following, such a medium is referred to as an artificial electric medium. Artificial magnetic media can also be constructed for which the permeability can be negative, with the permittivity roughly constant and positive. Structures in which local currents are generated that flow so as to produce solenoidal currents in response to applied electromagnetic fields, can produce the same response as would occur in magnetic materials. Generally, any element that includes a non-continuous conducting path nearly enclosing a finite area and that introduces capacitance into the circuit by some means, will have solenoidal currents induced when a time-varying magnetic field is applied parallel to the axis of the circuit.

We term such an element a solenoidal resonator, as such an element will possess at least one resonance at a frequency $\omega_{m0}$ determined by the introduced capacitance and the inductance associated with the current path. Solenoidal currents are responsible for the responding magnetic fields, and thus solenoidal resonators are equivalent to magnetic scatterers. A simple example of a solenoidal resonator is ring of wire, broken at some point so that the two ends come close but do not touch, and in which capacitance has been increased by extending the ends to resemble a parallel plate capacitor. A composite medium composed of solenoidal resonators, spaced closely so that the resonators couple magnetically, exhibits an effective permeability. Such an composite medium was described in the text by I. S. Schelkunoff and H. T. Friis, *Antennas: Theory and Practice*, Ed. S. Sokolnikoff (John Wiley & Sons, New York, 1952), in which the generic form of the permeability (in the absence of resistive losses) was derived as $$\mu(\omega) = 1 - \frac{F\omega^2}{\omega^2 - \omega_{m0}^2} \qquad \text{EQTN. 2}$$

where F is a positive constant less than one, and $\omega_{m0}$ is a resonant frequency. Provided that the resistive losses are low enough, EQTN 2 indicates that a region of negative permeability should be obtainable, extending from $\omega_{m0}$ to $\omega_{m0}/\sqrt{1-F}$.

In 1999, Pendry et al. revisited the concept of magnetic composite structures, and presented several methods by which capacitance could be conveniently introduced into solenoidal resonators to produce the magnetic response (Pendry et al., *Magnetism from Conductors* and *Enhanced Nonlinear Phenomena*, IEEE Transactions on Microwave Theory and Techniques, Vol. 47, No. 11, pp. 2075-84, Nov. 11, 1999). Pendry et al. suggested two specific elements that would lead to composite magnetic materials. The first was a two-dimensionally periodic array of "Swiss rolls," or conducting sheets, infinite along one axis, and wound into rolls with insulation between each layer. The second was an array of double split rings, in which two concentric planar split rings formed the resonant elements. Pendry et al. proposed that the latter medium could be formed into two- and three-dimensionally isotropic structures, by increasing the number and orientation of double split rings within a unit cell.

Pendry et al. used an analytical effective medium theory to derive the form of the permeability for their artificial magnetic media. This theory indicated that the permeability should follow the form of EQTN 2, which predicts very large positive values of the permeability at frequencies near but below the resonant frequency, and very large negative values of the permeability at frequencies near but just above the resonant frequency, $\omega_{m0}$.

Figure 4:
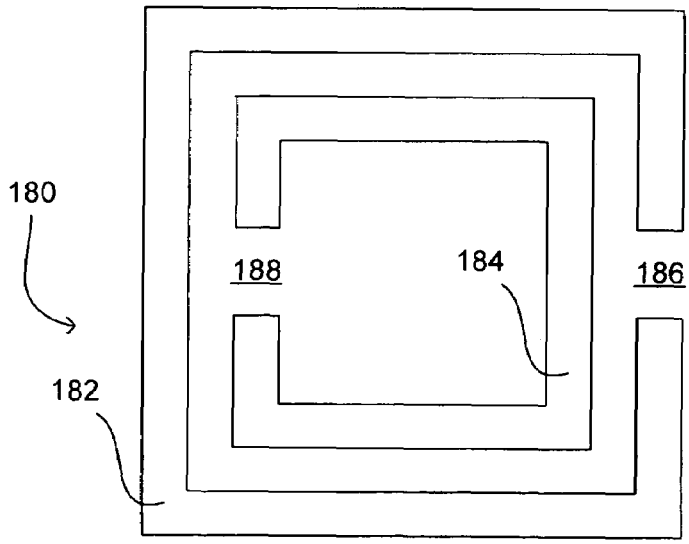
FIG. 4 illustrates an exemplary split ring resonator.

One example geometry that has proven to be of particular utility is that of a split ring resonator. FIG. 4 illustrates an exemplary split-ring resonator 180. The split ring resonator is made of two concentric rings 182 and 184, each interrupted by a small gap, 186 and 188, respectively. This gap strongly decreases the resonance frequency of the system. As will be appreciated by those skilled in the art and as reported by Pendry et al., a matrix of periodically spaced split ring resonators can be embedded in a dielectric to form a meta-material.

Those knowledgeable in the art will appreciate that exemplary meta-materials useful to make layers of structures of the invention are tunable by design by altering the wire conductor, split ring resonator, or other plasmon material sizing, spacing, and orientation to achieve material electromagnetic properties as may be desired. Also, combination of conductors may be made, with lengths of straight wires and split ring resonators being one example combination. That such a composite artificial medium can be constructed that maintains both the electric response of the artificial electric medium and the magnetic response of the artificial magnetic medium has been previously demonstrated.

Figure 5:
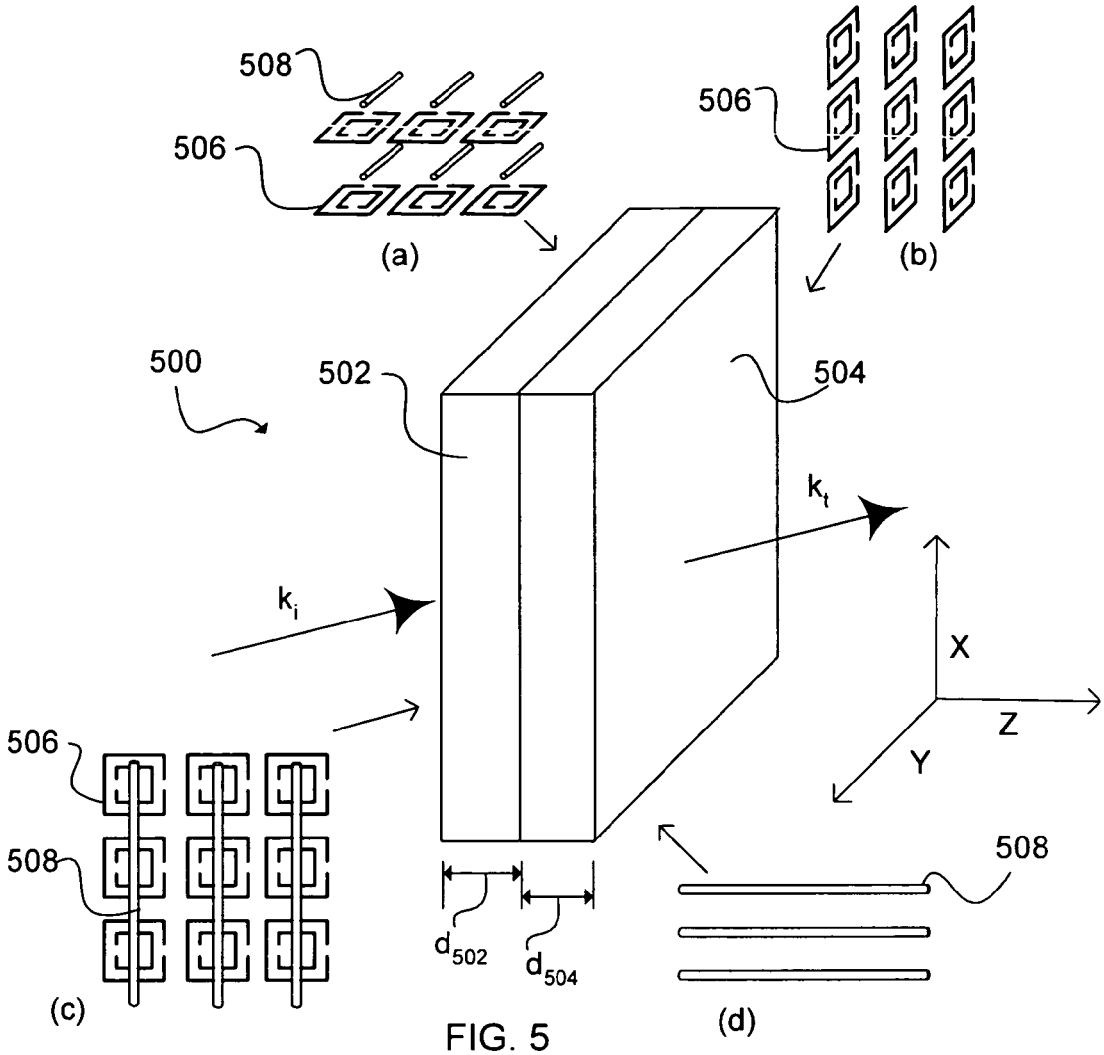
FIG. 5 is a schematic of an exemplary multi-layer compensating structure of the invention, with different meta-material embodiments shown at (a), (b), (c) and (d)

Having now described artificial electric and magnetic media, or metamaterials, that are useful as "building-blocks" to form multi-layer structures of the invention, the multi-layer structures themselves may be discussed. The structures are composed of layers, each an anisotropic medium in which not all of the principal components of the $\epsilon$ and $\mu$ tensors have the same sign. Herein we refer to such media as indefinite. FIG. 5 illustrates one exemplary structure 500 made of the com-pensating layers 502 and 504. For convenience, reference X, Y and Z axes are defined as illustrated, with the normal axis defined to be the Z-axis. The layers 502 and 504 have a thickness $d_{502}$ and $d_{504}$. In practice, the thicknesses $d_{502}$ and $d_{504}$ may be as small as or less than one or a few wavelengths of the incident waves.

Each of the layers 502 and 504 are preferably meta-materials made of a dielectric with arrays of conducting elements contained therein. Exemplary conductors include a periodic arrangement of split ring resonators 506 and/or wires 508 in any of the configurations generally shown at (a), (b), (c) and (d) in FIG. 5.

The properties of each exemplary structure (502 or 504, for example) may be illustrated using a plane wave with the electric field polarized along the y-axis having the specific form (although it is generally possible within the scope of the invention to construct media that are polarization independent, or exhibit different classes of behavior for different polarizations):

$$E=\hat{y}e^{i(k_x x+k_z z-\omega t)}. \qquad \text{EQTN. 3}$$

The plane wave solutions to Maxwell's equations with this polarization have $k_y=0$ and satisfy:

$$k_z^2=\varepsilon_y\mu_x\frac{\omega^2}{c^2}-\frac{\mu_x}{\mu_z}k_x^2 \qquad \text{EQTN. 4}$$

Since there are no x or y oriented boundaries or interfaces, real exponential solutions, which result in field divergence when unbounded, are not allowed in those directions; $k_x$ is thus restricted to be real. Also, since $k_x$ represents a variation transverse to the surfaces of the exemplary layered media, it is conserved across the layers, and naturally parameterizes the solutions.

In the absence of losses, the sign of $k_z^2$ can be used to distinguish the nature of the plane wave solutions. $k_z^2>0$ corresponds to real valued $k_z$ and propagating solutions, and $k_z^2<0$ corresponds to imaginary $k_z$ and exponentially growing or decaying (evanescent) solutions. When $\epsilon_y\mu_z>0$, there will be a value of $k_x$ for which $k_z^2=0$. This value, referred to herein as $k_c$, is the cutoff wave vector separating propagating from evanescent solutions. From EQTN. 4, this value is:

$$k_c=\frac{\omega}{c}\sqrt{\varepsilon_y\mu_z}$$

Four classes of media may be identified based on their cutoff properties:

| | Media Conditions | | Propagation |
|---|---|---|---|
| Cutoff | $\epsilon_y\mu_x>0$ | $\mu_x/\mu_z>0$ | $k_x<k_c$ |
| Anti-Cutoff | $\epsilon_y\mu_x<0$ | $\mu_x/\mu_z<0$ | $k_x>k_c$ |
| Never Cutoff | $\epsilon_y\mu_x>0$ | $\mu_x/\mu_z<0$ | all real $k_x$ |
| Always Cutoff | $\epsilon_y\mu_x<0$ | $\mu_x/\mu_z>0$ | no real $k_x$ |

Note the analysis presented here is carried out at constant frequency, and that the term "cutoff" is intended to broadly refer to the transverse component of the wave vector, $k_x$, not the frequency, ω. Iso-frequency contours, ω(k)=const, show the required relationship between $k_x$ and $k_z$ for plane wave solutions, as illustrated in the plots of FIG. 6

Figure 6:
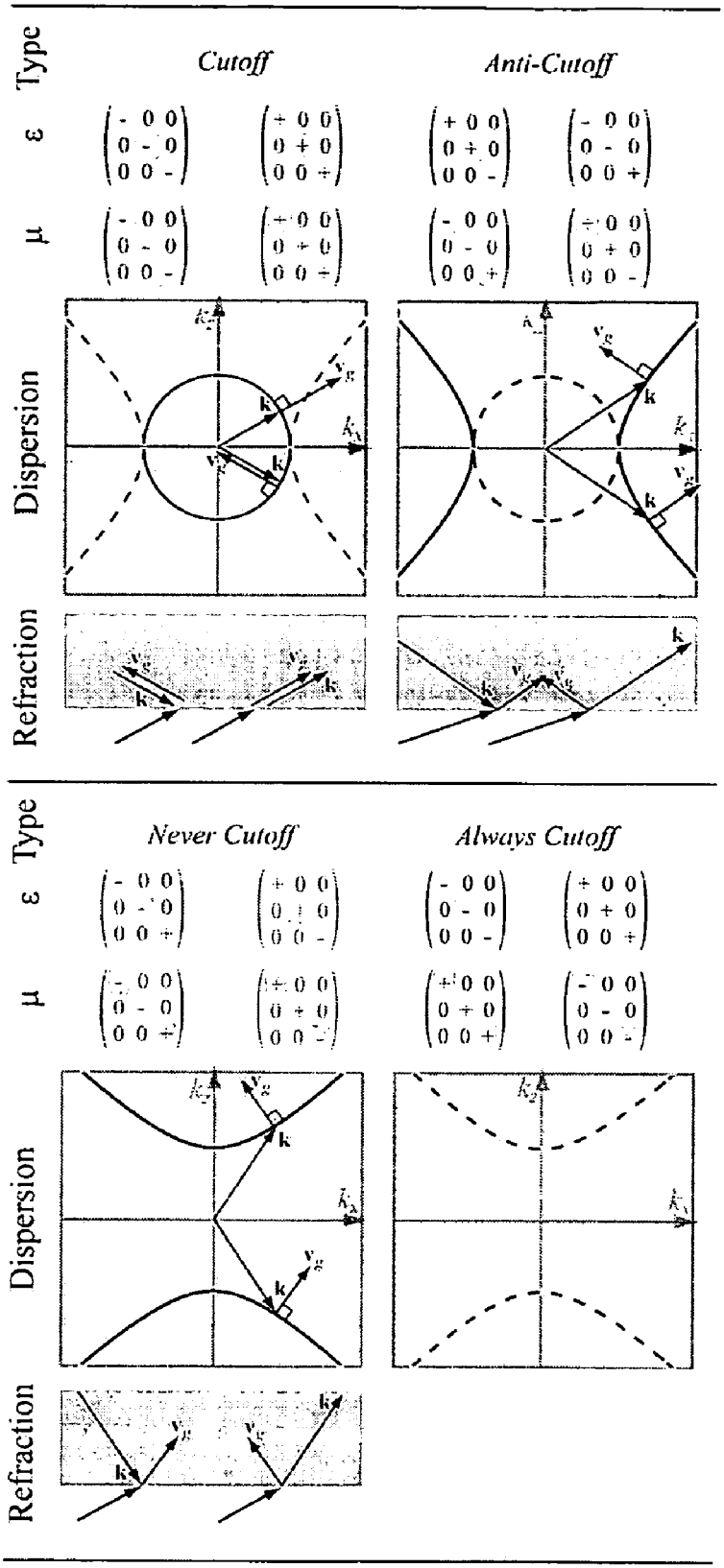
FIG. 6 includes data plots that illustrate material tensor forms, dispersion plot, and refraction data for four types of materials.

The data plots of FIG. 6 include material property tensor forms, dispersion plots, and refraction diagrams for four classes of media. Each of these media has two sub-types: one positive and one negative refracting, with the exception that always cutoff media does not support propagation and refraction. The dispersion plot (FIG. 6) shows the relationship between the components of the wave vector at fixed frequency. $k_x$ (horizontal axis) is always real, $k_z$ (vertical axis) can be real (solid line) or imaginary (dashed line). The closed contours are shown circular, but can more generally be elliptical. The same wave vector and group velocity vectors are shown in the dispersion plot and the refraction diagram. $v_g$ shows direction only. The shaded diagonal tensor elements are responsible for the shown behavior for electric y-polarization, the unshaded diagonal elements for magnetic y-polarization.

In order to further consider operation of bi-layer indefinite materials of the invention, it is helpful to first examine the general relationship between the directions of energy and phase velocity for waves propagating within an indefinite medium by calculating the group velocity, $v_g\equiv\nabla_k\omega(k)$. $v_g$ specifies the direction of energy flow for the plane wave, and is not necessarily parallel to the wave vector. $\nabla_k\omega(k)$ must lie normal to the iso-frequency contour, ω(k)=const. Calculation of $\nabla_k\omega(k)$ from the dispersion relation, EQTN. 3, determines which of the two possible normal directions yields increasing ω and is thus the correct group velocity direction. Performing an implicit differentiation of EQTN. 4 leads to a result for the gradient that does not require square root branch selection, removing any sign confusion.

To obtain physically meaningful results, a causal, dispersive response function, ξ(ω), may be used to represent the negative components of ϵ and μ, since these components are necessarily dispersive. The response function should assume the desired (negative) value at the operating frequency, and satisfy the causality requirement that $\partial(\xi\omega)/\partial\omega\geqq 1$. Combining this with the derivative of EQTN. 4 determines which of the two possible normal directions applies, without specifying a specific functional form for the response function. FIG. 6 relates the direction of the group velocity to a given material property tensor sign structure.

Having calculated the energy flow direction, the refraction behavior of indefinite media of the invention may be determined by applying two rules: (i) the transverse component of the wave vector, $k_x$, is conserved across the interface, and (ii) energy carried into the interface from free space must be carried away from the interface inside the media; i.e., the normal component of the group velocity, $\upsilon_{gz}$, must have the same sign on both sides of the interface. FIG. 6 shows typical refraction diagrams for the three types of media that support propagation.

The always cutoff and anticutoff indefinite media described above have unique hyperbolic isofrequency curves, implying that waves propagating within such media have unusual properties. The unusual isofrequency curves also imply a generally poor mismatch between them and free space, so that indefinite media are opaque to electromagnetic waves incident from free space (or other positive or negative definite media) at most angles of incidence. By combining negative refracting and positive refracting versions of indefinite media, however, composite structures can be formed that are well matched to free space for all angles of incidence.

To illustrate some of the possibilities associated with compensated bilayers of indefinite media of the invention, it is noteworthy that a motivating factor in recent metamaterials efforts has been the prospect of near-field focusing. A planar slab with isotropic ϵ=μ=−1 can act as a lens with resolution well beyond the diffraction limit. It is difficult, however, to realize significant sub-wavelength resolution with an isotropic negative index material, as the required exponential growth of the large $k_x$ field components across the negative index lens leads to extremely large field ratios. Sensitivity to material loss and other factors can significantly limit the sub-wavelength resolution.

It has been discovered that a combination of positive and negative refracting layers of never cutoff indefinite media can produce a compensated bilayer that accomplishes near-field focusing in a similar manner to the perfect lens, but with significant advantages. For the same incident plane wave, the z component of the transmitted wave vector is of opposite sign for the two different layers. Combining appropriate lengths of these materials results in a composite indefinite medium with unit transfer function. We can see this quantitatively by computing the general expression for the transfer function of a bilayer using standard boundary matching techniques:

$$T = 8\left[e^{i(\phi+\psi)}(1-Z_0)(1+Z_1)(1-Z_2) + e^{i(\phi-\psi)}(1-Z_0)(1-Z_1)(1+Z_2) + e^{i(-\phi+\psi)}(1+Z_0)(1-Z_1)(1-Z_2) + e^{i(-\phi-\psi)}(1+Z_0)(1+Z_1)(1+Z_2)\right]^{-1} \quad \text{EQTN. 5}$$

The relative effective impedances are defined as:

$$Z_0 = \frac{q_{z1}}{\mu_{x1}k_z},\quad Z_1 = \frac{\mu_{x1}}{\mu_{x2}}\frac{q_{z2}}{q_{z1}},\ Z_2 = \mu_{x2}\frac{k_z}{q_{z2}}, \quad \text{EQTN. 6}$$

where k, $q_1$ and $q_2$ are the wave vectors in vacuum and the first and second layers of the bilayers, respectively. The individual layer phase advance angles are defined as $\phi \equiv q_{z1}L_1$ and $\psi \equiv q_{z2}L_2$, where $L_1$ is the thickness of the first layer and $L_2$ is the thickness of the second layer. If the signs of $q_{z1}$ and $q_{z2}$ are opposite as mentioned above, the phase advances across the two layers can be made equal and opposite, $\phi+\psi=0$. If we further require that the two layers are impedance matched to each other, $Z_1=1$, then EQTN. 5, reduces to T=1, (very different from the transfer function of free space is $T=e^{ik_z(L_1+L_2)}$). In the absence of loss, the material properties can be chosen so that this occurs for all values of the transverse wave vector, $K_x$.

Figure 7:
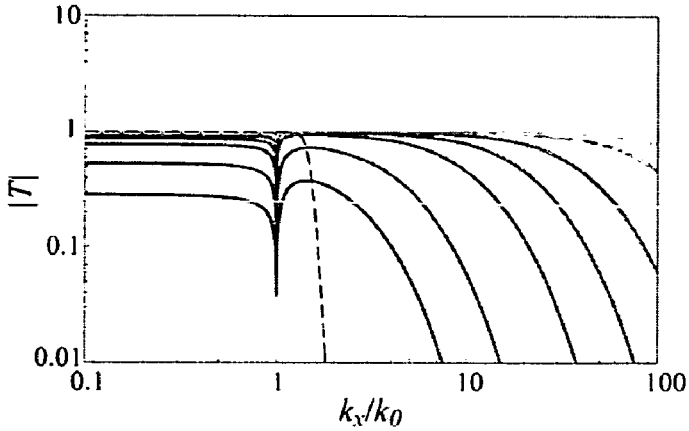
FIG. 7 illustrates the magnitude of the transfer function vs. transverse wave vector, $k_x$, for a bilayer composed of positive and negative refracting never cutoff media.

FIG. 7 illustrates the magnitude of the transfer function vs. transverse wave vector, $k_x$, for a bilayer composed of positive and negative refracting never cutoff media. Material property elements are of unit magnitude and layers of equal thickness, d. A loss producing imaginary part has been added to each diagonal component of $\epsilon$ and $\mu$, with values 0.001, 0.002, 0.005, 0.01, 0.02, 0.05, 0.1 for the darkest to the lightest curve. For comparison, a single layer, isotropic near field lens (i.e. the "perfect lens" proposed by Pendry) is shown dashed. The single layer has thickness, d, and $\epsilon=\mu=-1+0.001i$.

Referring again to the exemplary multi-layer indefinite material of FIG. 6, the conductor elements 506 and 508 in the configuration shown in (a) and (b) will implement never-cutoff media for electric y-polarization. (a) is negative refracting, and (b) is positive refracting. The conductor elements 506 and 508 in the configuration shown in (b) and (c) will implement never-cutoff media for magnetic y polarization, with (c) being negative refracting and (d) being positive refracting.

Combining the two structures 502 and 504 forms a bilayer 500 that is x-y isotropic due to the symmetry of the combined lattice. This symmetry and the property $\mu=\epsilon$ yield polarization independence. The configuration of the split ring resonators 506 and wires 508 can be developed using numerically and experimentally confirmed effective material properties. Each split ring resonator 506 orientation implements negative permeability along a single axis, as does each wire 508 orientation for negative permittivity.

To further illustrate compensating multi-layers of the invention, it is useful to co consider an archtypical focusing bilayer. In this case, the $\epsilon$ and $\mu$ tensors are equal to each other and thus ensure that the focusing properties are independent of polarization. The $\epsilon$ and $\mu$ tensors are also X-Y isotropic so that the focusing properties are independent of the X-Y orientation of the layers. This is the highest degree of symmetry allowed for always propagating media. If all tensor components are assigned unit magnitude, then:

$$\varepsilon_1 = \mu_1 = \begin{pmatrix} 1 & 0 & 0 \\ 0 & 1 & 0 \\ 0 & 0 & -1 \end{pmatrix} \quad \varepsilon_2 = \mu_2 = \begin{pmatrix} -1 & 0 & 0 \\ 0 & -1 & 0 \\ 0 & 0 & 1 \end{pmatrix}$$

In this case the layer thickness must be equal for focusing, $d_{502}=d_{504}$ (FIG. 5). These values result in a transfer function of unity for all incident plane waves, T=1. The magnitude is preserved and the phase advance across the bilayer is zero.

Figure 8:
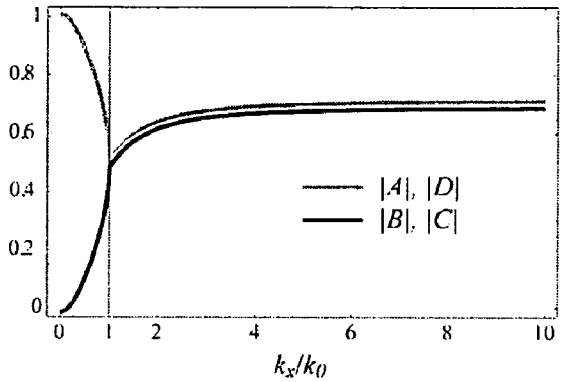
FIG. 8 is a data plot of showing the magnitude of coefficients of the internal field components.

The internal field coefficients (A, B, C, D) are plotted in FIG. 8. Evanescent incident waves ($k_x/k_0>1$) carry no energy, but on entering the bilayer are converted to propagating waves. Since propagating waves do carry energy the forward and backward coefficients must be equal; the standing wave ratio must be and is unity. Propagating incident waves, however, do transfer energy across the bilayer. As shown in FIG. 8, for propagating incident waves, ($k_x/k_0<1$), the first layer, forward coefficient A is larger in magnitude than the backward coefficient B. These rolls are reversed in the second layer: D>C. It is noted that what is referred to as "forward" really means positive z-component of the wave vector. This does not indicate the direction of energy flow which is given by the group velocity. The z-component of the group velocity must be positive in both layers to conserve energy across the interfaces. The electric field may be described quite simply in the limit $k_x>>k_0$.

$$\begin{aligned} E_y &= e^{i|k_x x-\omega t|} \\ &= e^{-zk_x} \text{ for } z<0 \\ &= \sqrt{2}\cos\left(zk_x+\frac{\Pi}{4}\right) \text{ for } 0<z<d \\ &= \sqrt{2}\cos((2d-z))k_x+\frac{\Pi}{4}) \text{ for } d<z<2d \\ &= e^{-(z-2d)k_x} \text{ for } 2d<z \end{aligned}$$

Thus the internal field is indeed a standing wave, and is symmetric about the center of the bilayer. This field pattern is shown in FIG. 9.

Figure 9:
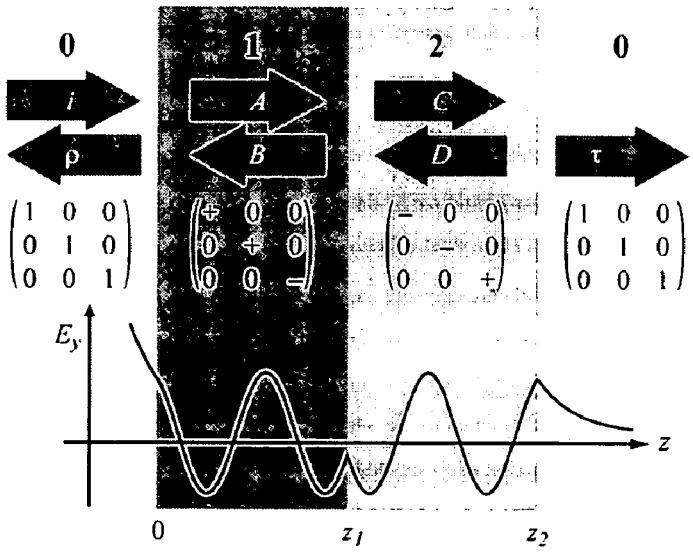
FIG. 9 illustrates material properties and their indices, conventions, and other factors.

FIG. 9 shows, from top to bottom; 1. the indices used to refer to material properties, 2. the conventions for the coefficients of each component of the general solution, 3. the sign structure of the material property tensors, 4. typical z-dependence of the electric field for an evanescent incident plane wave, and 5. z-coordinate of the interfaces Within the scope of the present invention, the above discussed symmetry may be relaxed to obtain some different behavior. In particular, the previous discussion had the property tensor elements all at unit magnitude, thereby leading to dispersion slope of one. A different slope, m, may be introduced as follows $$\varepsilon_1 = \mu_1 = \begin{pmatrix} m_1 & 0 & 0 \\ 0 & m_1 & 0 \\ 0 & 0 & \frac{-1}{m_1} \end{pmatrix}$$

$$\varepsilon_2 = \mu_2 = \begin{pmatrix} -m_2 & 0 & 0 \\ 0 & -m_2 & 0 \\ 0 & 0 & \frac{1}{m_2} \end{pmatrix}$$

Allowing the slope m to differ in each layer can still maintain a unit transfer function, T=1, if the thickness of the layers d is adjusted appropriately:

$$\frac{d_2}{d_1} = \frac{m_1}{m_2}$$

Figure 10:
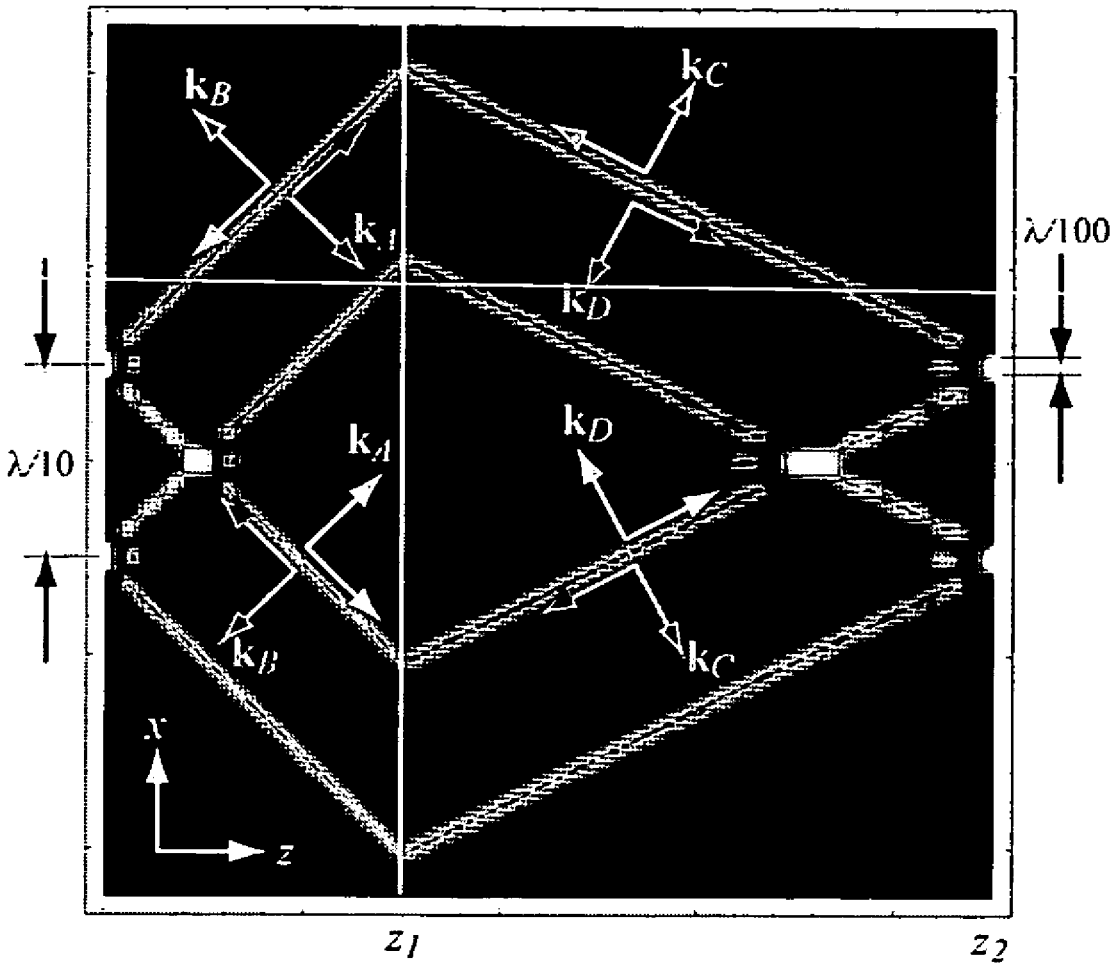
FIG. 10 shows an internal electric field density plot for a localized two slit source.

Polarization independence and x-y isotropy is maintained. The internal field for a bilayer with different slopes in each layer is shown in FIG. 10. The incident field is a localized source composed of many $k_x$ components. This source is equivalent to two narrow slits back illuminated by a uniform propagating plane wave. The plane wave components interfere to form a field intensity pattern that is localized in four beams, two for each slit. The beams diverge in the first layer and converge in the second layer to reproduce the incident field pattern on the far side. The plane waves that constructively interfere to form each beam have phase fronts parallel to the beam, (i.e. the wave vector is perpendicular to the beam.) The narrow slits yield a source which is dominated by large $k_x$ components. These components lie well out on the asymptotes of the hyperbolic dispersion, so all of the wave vectors point in just four directions, the four indicated in FIG. 10. These correspond to the positive and negative $k_x$ components in the source expansion and the forward and backward components of the solution (A,B or C, D).

It will be appreciated that indefinite materials of the invention that include multiple compensating layers have many advantages and benefits, and will be of great utility for many applications. One exemplary application is that of a spatial filter. The structure 500 of FIG. 5, for instance, may comprise a spatial filter.

Spatial filters of the invention such as that illustrated at 500 have many advantages over conventional spatial filters of the prior art. For example, a spatial filter band edge can be placed beyond the free space cut-off, making processing of near field components possible. Conventional spatial filters can only transmit components that propagate in the medium that surrounds the optical elements. Also, spatial filters of the present invention can be extremely compact. In many cases the spatial filter can consist of metamaterial layers that are less than about 10 wavelengths thick, and may be as small as one wavelength. Conventional spatial filters, on the other hand, are typically at least four focal lengths long, and are often of the order of hundreds of wavelengths thick Single layers of isotropic media with a cutoff different from that of free space as well as all anti-cutoff media have poor impedance matching to free space. This means that most incident power is reflected and a useful transmission filter cannot be implemented. It has been discovered that this situation is mitigated through compensating multi-layer structures of the invention. As discussed herein above, the material properties of one layer can be chosen to be the negative of the other layer. If the layer thicknesses are substantially equal to each other, the resulting bilayer then matches to free space and has a transmission coefficient that is unity in the pass band of the media itself.

Low pass filtering only requires isotropic media. The material properties of the two layers of the compensating bilayer are written explicitly in terms of the cutoff wave vector, $k_c$.

$$\varepsilon_1 = \mu_1 = \frac{k_c}{k_0}\sigma_0 + i\gamma\sigma_0$$

and $$\varepsilon_2 = \mu_2 = -\frac{k_c}{k_0}\sigma_0 + i\gamma\sigma_0.$$

$\gamma \lhd 1$ is the parameter that introduces absorptive loss. The cutoff, $k_c$, determines the upper limit of the pass band. Note that $\epsilon=\mu$ for both layers, so this device will be polarization independent. Adjusting the loss parameter, $\gamma$, and the layer thickness controls the filter roll off characteristics.

High pass filtering requires indefinite material property tensors.

$$\varepsilon_1 = \mu_2 = \frac{k_c}{k_0}\sigma_0 + i\gamma\sigma_0$$

and $$\varepsilon_2 = \mu_1 = -\frac{k_c}{k_0}\sigma_0 + i\gamma\sigma_0$$

Here, the cutoff wave vector, $k_c$, determines the lower limit of the pass band. With $\epsilon=-\mu$ for both layers, this device will be externally polarization independent.

The transmission coefficient, $\tau$, and the reflection coefficient, $\rho$, can be calculated using standard transfer matrix techniques. The independent variable is given as an angle, $\theta=\sin^{-1}(k_x/k_0)$, since in this range the incident plane waves propagate in real directions. For incident propagating waves, $k_x/k_0<1$ and $0<\theta<\pi/2$, the reflection and transmission coefficients must, and do obey, $|\rho|^2+|\tau|^2 \leqq 1$, to conserve energy. Incident evanescent waves, $k_x/k_0>1$ do not transport energy, so no such restriction applies.

Figure 11:
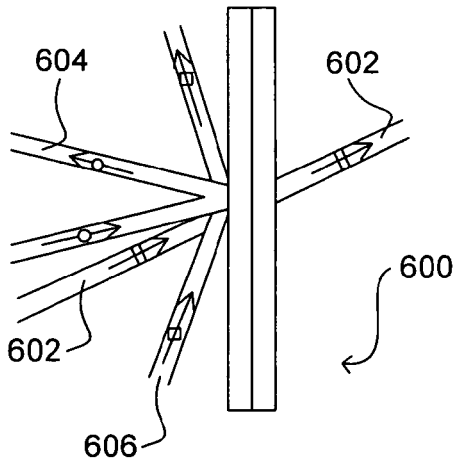
FIG. 11 is a schematic illustrating a compensating multi-layer spatial filter of the invention; and, FIG. 12 is a schematic of an exemplary antenna of the present invention.

Indefinite multi-layer spatial filters of the invention provide many advantages and benefits. FIG. 11 is useful to illustrate some of these advantages and benefits. The exemplary spatial filter shown generally at 600 combines two multi-layer compensating structures 500 (FIG. 5) of the invention. As illustrated, the spatial filter 600 can be tuned to transmit incident beams 602 that are in a mid-angle range while reflecting beams that are incident at small and large angles, 604 and 606 respectively. Standard materials cannot reflect normally incident beams and transmit higher angled ones. Also, though an upper critical angle is not unusual, it can only occur when a beam is incident from a higher index media to a lower index media, and not for a beam incident from free space, as is possible using spatial filters of the present invention. The action of the compensating layers also permits a greater transmittance with less distortion than is possible with any single layer of normal materials.

While compensated bilayers of indefinite media exhibit reduced impedance mismatch to free space and high transmission, uncompensated sections of indefinite media can exhibit unique and potentially useful reflection properties. This can be illustrated by a specific example. The reflection coefficient for a wave with electric y polarization incident from free space onto an indefinite medium is given by $$\rho = \frac{\mu_x k_z - q_z}{\mu_x k_z + q_z}$$

Where $k_z$ and $q_z$ refer to the z-components of the wave vectors in vacuum and in the medium, respectively. For a unit magnitude, positive refracting anti-cutoff medium, $$q_z^2 = -\frac{\omega^2}{c^2} + k_z^2 = -k_z^2.$$

Thus, $q_z = ik_z$, the correct (+) sign being determined by the requirement that the fields must not diverge in the domain of the solution. Thus, $\rho = -i$ for propagating modes for all incident angles; that is, the magnitude of the reflection coefficient is unity with a reflected phase of −90 degrees. An electric dipole antenna placed an eighth of a wavelength from the surface of the indefinite medium would thus be enhanced by the interaction. Customized reflecting surfaces are of practical interest, as they enhance the efficiency of nearby antennas, while at the same time providing shielding. Furthermore, an interface between unit cutoff and anti-cutoff media has no solutions that are simultaneously evanescent on both sides, implying an absence of surface modes, a potential advantage for antenna applications.

Figure 12:
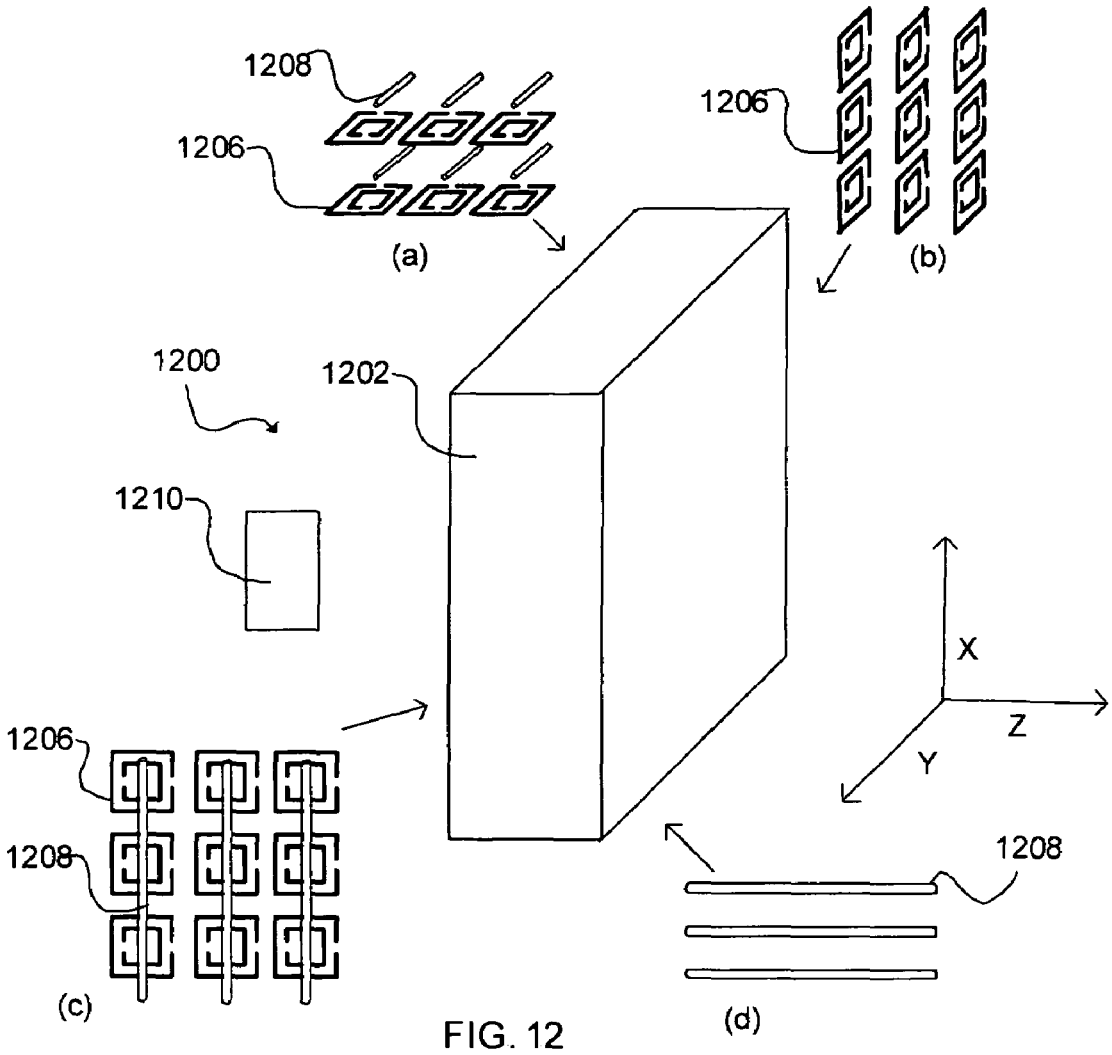

Single layer indefinite materials that are non-compensating may be useful as antenna. FIG. 12, for instance, shows one example of an antennae 1200 of the invention. It includes indefinite layer 1202, which may include any of the exemplary conductor(s) in a periodic arrangement shown generally at (a), (b), (c), and (d). These generally include split ring resonators 1206 and straight conductors 1208. A radiator shown schematically at 1210 may be placed proximate to the indefinite layer 1202, or may be embedded therein to form a shaped beam antenna. The radiator may be any suitable radiator, with examples including, but not limited to, a dipole, patch, phased array, traveling wave or aperture.

Those knowledgeable in the art will appreciate that although an embodiment of the invention has been shown and discussed in the particular form of a spatial filter, compensating multi-layer structures of the invention will be useful for a wide variety of additional applications and implementations. For example, power transmission devices, reflectors, antennae, enclosures, and similar applications may be embodied.

Antenna applications, by way of particular example, may utilize indefinite multi-layer materials of the invention to great advantage. For example, an indefinite multi-layer structure such as that shown generally at 500 in FIG. 5 may define an antenna substrate, with the antenna further including a radiator proximate to said antenna substrate. The antenna radiator may be any suitable radiator, with examples including, but not limited to, a dipole, patch, phased array, traveling wave or aperture. Other embodiments of the invention include a shaped beam antenna that includes an indefinite multi-layer material generally consistent with that shown at 500. The shaped beam antenna embodiment may further include a radiating element embedded therein.

Further, the present invention is not limited to two compensating layers, but may include a plurality of layers in addition to two. The spatial filter 600 of FIG. 11, for instance, combines two multi-layer compensating structures. By way of further example, a series of adjacent pairs of compensating layers may be useful to communicate electromagnetic waves over long distances.

What is claimed is:

1. A compensating multi-layer material comprising:

an indefinite anisotropic first layer having material properties of $\epsilon_1$ and $\mu_1$, both of $\epsilon_1$ and $\mu_1$ being tensors, and a thickness $d_1$;

an indefinite anisotropic second layer adjacent to said first layer, said second layer having material properties of $\epsilon_2$ and $\mu_2$ both of $\epsilon_2$ and $\mu_2$ being tensors, and having a thickness $d_2$ ; and, wherein $\epsilon_1$, $\mu_1$, $\epsilon_2$, and $\mu_2$ are simultaneously diagonalizable in a diagonalizing basis that includes a layer normal to said first and second layers, and $$\varepsilon_2 = \psi\varepsilon_1$$

$$\mu_2 = \psi\mu_1$$

where $$\varphi = -\begin{bmatrix} \frac{d_1}{d_2} & 0 & 0 \\ 0 & \frac{d_1}{d_2} & 0 \\ 0 & 0 & \frac{d_2}{d_1} \end{bmatrix}$$

and $\phi$ is a tensor represented in said diagonalizing basis with a third basis vector that is normal to said first and second layers.

2. A compensating multi-layer material as defined by claim 1 wherein said first and second layers are generally planar and of equal thickness, X and Y axes being defined along the plane of said generally planar first and second layers and a Z axis defined normal to said generally planar first and second layers, and wherein each of said material properties $\epsilon$ and $\mu$ for both of said layers are tensors that may be defined as:

$$\varepsilon_1 = -\varepsilon_2 = \begin{pmatrix} \varepsilon_x & 0 & 0 \\ 0 & \varepsilon_y & 0 \\ 0 & 0 & \varepsilon_z \end{pmatrix}$$

$$\mu_1 = -\mu_2 = \begin{pmatrix} \mu_x & 0 & 0 \\ 0 & \mu_y & 0 \\ 0 & 0 & \mu_z \end{pmatrix}.$$

3. A compensating multi-layer material as defined by claim 2 wherein each of said layers are composed of media with the Never Cutoff property for at least one polarization.

4. A compensating multi-layer material as defined by claim 3 wherein said at least one polarization is y-axis electric polarization, and wherein:

$$\varepsilon_y \mu_x > 0$$

$$\frac{\mu_x}{\mu_z} < 0$$

5. A compensating multi-layer material as defined by claim 2 wherein said first and second layers define a filter operative for at least one polarization to attenuate incident waves that are one of above or below a cutoff value of the transverse wavevector.

6. A compensating multi-layer material as defined by claim 5 wherein said filter is comprised of cutoff material if said incident waves are above said cutoff value, and wherein said filter is comprised of anti-cutoff material if said incident waves are below said cutoff value.

7. A compensating multi-layer material as defined by claim 5 wherein said at least one polarization is y-axis polarization, and wherein said cutoff value of the transverse wavevector is expressed as $k_c$:

$$k_c = k_0\sqrt{(\varepsilon_y \mu_z)} \text{ where } k_0 = \frac{2\pi}{\lambda}$$

and $\lambda$ is the free space wavelength.

8. A compensating multi-layer material as defined by claim 1 wherein $\epsilon_1=\mu_1$, and $\epsilon_2=\mu_2$.

9. A compensating multi-layer material as defined by claim 1 wherein said first and second layers are generally planar and parallel to one another.

10. A compensating multi-layer material as defined by claim 1 wherein said first and second layers each have a length and a width, said lengths and widths being much larger than said thicknesses $d_1$ and $d_2$.

11. A compensating multi-layer material as defined by claim 1 wherein $d_1=d_2$.

12. A compensating multi-layer material as defined by claim 1 wherein each of said layers comprises a composite material including a host dielectric and one of an artificial electric or magnetic medium embedded in said host medium.

13. A compensating multi-layer material as defined by claim 12 wherein said artificial electric or magnetic medium comprises one or more conductors in a periodically spaced arrangement.

14. A compensating multi-layer material as defined by claim 12 wherein said artificial electric or magnetic medium comprises one or both of split ring resonators and substantially straight wires in a periodic spatial arrangement.

15. A compensating multi-layer material as defined by claim 12 wherein said dielectric host comprises one or more members selected from the group consisting of: thermoplastics, ceramics, oxides of metals, and mica.

16. A compensating multi-layer material as defined by claim 1 wherein said first and second layers define a first layer pair, and wherein the compensating multi-layer material further includes a plurality of additional layer pairs sequentially adjacent to one another to form a continuous series of layer pairs, each of said additional layer pairs comprised of two indefinite anistropic layers that define a compensating structure.

17. A compensating multi-layer material as defined by claim 16 wherein each of said additional layer pairs are substantially identical to said first and second layers.

18. A compensating multi-layer material as defined by claim 1 wherein each of said first and second layers have a thickness of less than about 10 wavelengths of an incident wave.

19. A compensating multi-layer material as defined by claim 1 wherein said first and second layers at least partially define a spatial filter configured to reflect beams incident to said layers at low angles to the normal and to transmit beams incident at higher angles for at least one polarization.

20. A compensating multi-layer material as defined by claim 1 wherein said first and second layers are configured to define one of a high-pass or a low-pass spatial filter.

21. A compensating multi-layer material as defined by claim 1 wherein said first and second layers at least partially define a spatial filter configured to define an upper critical angle above which incident beams from free space will be reflected for at least one polarization.

22. A multi-layer compensating material as defined by claim 1 wherein said first and second layers define a first pair of compensating bilayers, and further including a second pair of compensating bilayers, said first pair of compensating layers defining a low pass spatial filter and said second pair defining a high pass spatial filter, so that the first and second pair together define a band pass spatial filter configured to transmit incident beams that are in a mid-angle range while reflecting beams that are incident at angles smaller than said mid-angle range and larger than said mid-angle range for at least one polarization.

23. A compensating multi-layer material as defined by claim 1 wherein one of said first or said second layers defines an input plane and the other an output plane, and wherein said first and second layers are configured to couple electromagnetic distribution from said input plane to said output plane with a unity transverse-wave-vector transfer function that can extend substantially beyond the free space transverse-wave-vector cutoff and into the near field components for at least one polarization.

24. A compensating multi-layer material as defined by claim 1 wherein one of said first or said second layers defines an input plane and the other an output plane, and wherein said first and second layers are configured to couple electromagnetic distribution from said input plane to said output plane with a high-pass, transverse-wave-vector transfer function, and the high-pass roll-off may lie above the free space transverse-wave-vector cutoff for at least one polarization.

25. A compensating multi-layer material as defined by claim 1 wherein one of said first or said second layers defines an input plane and the other an output plane, and wherein said first and second layers are configured to couple electromagnetic distribution from said input plane to said output plane with a low-pass, transverse-wave-vector transfer function, with a low-pass roll-off being above the free space transverse-wave-vector cutoff for at least one polarization.

26. An indefinite multi-layer material as defined by claim 1 wherein said first and second layers define an antenna substrate, the antenna further including a radiator proximate to said antenna substrate.

27. An indefinite material as defined by claim 26, wherein said radiator comprises one of a dipole, patch, phased array, traveling wave or aperture.

28. A shaped beam antenna including the indefinite multi-layer material defined by claim 1 said shaped beam antenna further including a radiating element embedded therein.

29. A compensating multi-layer material comprising:

an indefinite anisotropic first layer having material properties of $\epsilon_1$ and $\mu_1$, both of $\epsilon_1$ and $\mu_1$ being tensors, and a thickness $d_1$;

an indefinite anisotropic second layer adjacent to said first layer, said second layer having material properties of $\epsilon_2$ and $\mu_2$, both of $\epsilon_2$ and $\mu_2$ being tensors, and having a thickness $d_2$, wherein the necessary tensor components for compensation satisfy:

$$\varepsilon_2 = \psi\varepsilon_1$$

$$\mu_2 = \psi\mu_1$$

where

-continued $$\varphi = -\begin{bmatrix} \frac{d_1}{d_2} & 0 & 0 \\ 0 & \frac{d_1}{d_2} & 0 \\ 0 & 0 & \frac{d_2}{d_1} \end{bmatrix}$$

and $\psi$ is a tensor represented in said diagonalizing basis with a third basis vector that is normal to said first and second layers, where the necessary components are:

$\epsilon_y$, $\mu_x$, $\mu_z$ for y-axis electric polarization, $\epsilon_x$, $\mu_y$, $\mu_z$ for x-axis electric polarization, $\mu_y$, $\epsilon_x$, $\epsilon_z$, for y-axis magnetic polarization, and $\mu_x$, $\epsilon_y$, $\epsilon_z$ for x-axis magnetic polarization; and wherein the other tensor components may assume any value including values for free space.

* * * * *